US006063239A

United States Patent [19]

Howland et al.

[11] Patent Number: 6,063,239

[45] Date of Patent: May 16, 2000

[54] SECURITY PAPER

[75] Inventors: Paul Howland; Jonathan Paul Foulkes, both of Andover, United Kingdom

[73] Assignee: Portals Limited, London, United Kingdom

[21] Appl. No.: 09/101,042

[22] PCT Filed: Dec. 18, 1996

[86] PCT No.: PCT/GB96/03120

§ 371 Date: Jun. 29, 1998

§ 102(e) Date: Jun. 29, 1998

[87] PCT Pub. No.: WO97/25476

PCT Pub. Date: Jul. 17, 1997

[30] Foreign Application Priority Data

Jan. 12, 1996 [GB] United Kingdom ..... 9600686

[51] Int. Cl.[7] ..... D21F 1/44; D21F 11/00; D21H 11/00

[52] U.S. Cl. ..... 162/110; 162/116; 162/140; 162/146; 162/157.2; 162/157.3; 162/109

[58] Field of Search ..... 162/110, 116, 162/140, 146, 157.2, 109, 157.3

[56] References Cited

U.S. PATENT DOCUMENTS

| | | | |
|---|---|---|---|
| 1,616,222 | 2/1927 | Harrigan | 162/348 |
| 3,114,670 | 12/1963 | Iwasaki . | |
| 4,267,016 | 5/1981 | Okazaki et al. . | |
| 4,534,398 | 8/1985 | Crane | 162/103 |

FOREIGN PATENT DOCUMENTS

| | | |
|---|---|---|
| 0319157 | 6/1989 | European Pat. Off. . |
| 1411338 | 1/1969 | Germany . |
| 9301835 | 5/1985 | Netherlands . |
| 964300 | 7/1964 | United Kingdom . |
| 1283405 | 7/1972 | United Kingdom . |

OTHER PUBLICATIONS

O. A. Battista, "Synthetic Fibers in Papermaking", Interscience Publishers, pp. 69–70, 1964.

*Primary Examiner*—Peter Chin
*Assistant Examiner*—Dionne A. Walls
*Attorney, Agent, or Firm*—Watson Cole Grindle Watson, P.L.L.C.

[57] ABSTRACT

The invention relates to security paper and in particular to a method for the manufacture of security paper that is provided with high-quality watermarks. In particular such a method comprises forming a papermaking suspension comprising cellulosic fibers and polyvinyl alcohol fibers, which polyvinyl alcohol fibers are soluble in water at temperatures of from 95 to 100 degrees C, dewatering the papermaking suspension through an emboseed wire mesh or other embossed means, wherein the embossing creates a profile of peaks and troughs corresponding to the light and dark areas of the watermark, and the formed paper after dewatering with the watermark feature is thereafter dried to provide the resulting security paper.

9 Claims, No Drawings

SECURITY PAPER

The invention relates to security paper and in particular to a method for the manufacture of security paper which are provided with high-quality watermarks.

It is well-known to those skilled in the art of papermaking that the tear strength of paper can be increased by the use of relatively long synthetic fibres. Cotton fibres used in the manufacture of security paper such as banknote paper are typically 1 mm long. Tear-enhancing synthetic fibres are however typically in the region of 3 to 5 mm long. It is further well-known in the papermaking art that the double-fold and tensile strength properties are generally also improved by the addition of synthetic fibres, but only if such fibres can be effectively bonded into the surrounding matrix of cotton fibres. Bonding of the appropriate type has been achieved in the past by three techniques:

1. One technique is to use a fibre which is capable of hydrogen bonding such as viscose or polyvinyl alcohol. This technique is of limited value because the surface area of synthetic fibres is generally rather low compared to that of natural fibres with the consequence that the hydrogen bonding forces with individual synthetic fibres are proportionately less than for a cellulosic fibre. This reduction in bonding forces is only partially compensated by using fibres of greater length than cellulosic or other natural fibres.
2. Use has been made to impregnate a substrate with a strong bonding agent such as polyvinyl alcohol or gelatin. In practice it is rather difficult to make this method work effectively without resorting to either solvent-based systems and/or hot calendaring, neither of which are desirable due to their high cost. In the case of solvent-based systems, environmental considerations also mitigate against this approach.
3. Use has also been made of binder fibre incorporated with a synthetic reinforcing fibre. The binding fibre must be capable of either melting or dissolving during the drying process thereby serving to bond the synthetic and natural components of the fibre substrate.

Dutch Patent publication No.9301835 discloses a procedure for manufacturing paper for security applications and in addition to cellulose fibres, uses insoluble polyvinyl alcohol fibres, or a quantity of soluble and insoluble polyvinyl alcohol fibres. The use of the insoluble polyvinyl alcohol fibres improves the strength and stiffness of the paper compared with paper containing only cellulose fibres. In comparison with paper using other synthetic fibres such as polyamide or polyethylene fibres, the paper in accordance with this patent publication exhibits better stiffness and definition of a watermark. The soluble polyvinyl alcohol fibres which may be used in accordance with the disclosure are those which dissolve in water at a temperature 60° C. or higher and during the dissolving the soluble fibres disappear. The molecules of polyvinyl alcohol act as a binding agent and may provide a surface effect such that no normal surface treatment is required in order to provide a good print performance. The specification as a whole makes it clear that reasonable watermark quality is achieved even though a synthetic fibre is used, namely the insoluble polyvinyl alcohol fibres. In contrast to the invention disclosed in Dutch patent publication No.9301835 this present invention is concerned with obtaining improved strength relative to security paper made from cellulosic fibres alone and also improved watermark quality relative to other types of insoluble PVOH fibre by the use of a certain amount of polyvinyl alcohol fibres which have the ability to dissolve at temperatures of 95° C. to 100° C.

The mould made panel watermark is one of the most critical and important security features used in bank notes to deter forgery. This is clearly illustrated by the almost universal use of such watermarks throughout the world's currencies. It is critical to the counterfeit deterrent value of a watermark that it be of the highest quality.

Judging the quality of a watermark is essentially a subjective issue. However those skilled in the art of producing mould made panel watermarks, referred to as shadow watermarks in Dutch patent application 9310835, are familiar with several distinct quality criteria. A high quality watermark is distinguished by three key features:

First, it should be sharply defined; that is to say, the image should not be woolly or smudged.

Second, it should be highly contrasted; that is to say, there should be a marked difference between the light and dark areas when viewed in transmitted light. The light areas, known as highlights should be much lighter than the non-watermarked area. The dark areas should be distinctly darker than the surrounding non-watermarked area.

Third, in order to present the watermark to best effect and to ensure consistent reproducibility of its image the background formation of the paper (non-watermarked area) should be uniform.

Of all the above qualities, the dark area contrast is the easiest to quantify. This can be done by estimating the quantity of fibre in the higher grammage areas of the watermark in comparison to the non-watermarked area.

The above-mentioned Dutch application does not describe the criteria used for judging watermark quality. Furthermore, it does not state which of the subjective aspects of watermark quality are used to make judgements about the watermark quality of the paper containing insoluble PVOH fibres and that containing other synthetic fibres or only cotton fibre.

The traditional approach to the use of synthetic fibres in papermaking leads one skilled in the art to choose a fibre which has maximum hydrogen bonding, maximum length consistent with paper formation and an optimal chemical bonding system. It should also be understood that the tear-strength in particular is a function primarily of fibre strength and the double-fold property is a function of both fibre strength and bonding strength.

In the production of security paper such as banknote paper, it is important to maximise the two important physical properties, namely tear-strength and double-fold values. The teaching in the art is that in order to achieve good results in respect of these two physical properties it is appropriate to use a reinforcing fibre which will be undamaged either by heat or water in order to maintain maximum fibre strength. It has now been surprisingly discovered that the use of polyvinyl alcohol fibres which are soluble in the papermaking process at least to some extent at temperatures between 95° and 100° C., but which nevertheless maintain strength properties throughout the entire papermaking process including the drying stages. In particular it has been discovered that security paper made in accordance with the method of this invention is not weakened during the drying stages during which the fibres are surrounded by water at a temperature approaching 100° C. prior to the evaporation of the water.

Accordingly, the present invention provides a method for the manufacture of security paper, such as banknote paper, which method comprises forming a papermaking suspension comprising cellulosic fibres and polyvinyl alcohol fibres, which polyvinyl alcohol fibres are soluble in water at temperatures of from 95° to 100° C., dewatering the papermaking suspension through an embossed wire mesh or other embossed means, wherein the embossing creates a profile of peaks and troughs corresponding to the light and dark areas of the watermark, and the formed paper after dewatering with the watermark feature is thereafter dried to provide the resulting security paper.

The cellulosic fibres may comprise at least 50% of the papermaking suspension and they may be both linter and comber fibres; additionally, fibres may be linen hemp or manila (abaca) fibres. It is preferred that cellulose fibres are present in an amount of at least 30% by weight and more preferably at least 90% by weight. The polyvinyl alcohol fibres which are soluble in water at temperature of from 90° to 100° C. may be present in amounts of up to about 10% by weight and are Preferably present in an amount of 2 to 10% and more preferably from 4 to 8% by weight based on the weight of the fibres in the papermaking suspension.

The polyvinyl alcohol fibres which are soluble in water at temperatures of from 95° to 100° C. preferably have a length up to 5 mm and more preferably from 3 to 5 mm; the denier of these fibres may be up to 2 denier, or preferably 0.3 to 2 denier and more preferably 1 denier.

The polyvinyl alcohol fibres which are soluble in water at temperature of from 95° to 100° C. may have a core formed from some different polymeric fibre material, for example polyester, a polyamide viscose or a water-insoluble polyvinyl alcohol. These fibres with the core may be considered to be equivalent to normal polyvinyl alcohol fibres in that they provide a polyvinyl alcohol surface which is essential in the method according to this invention in order to obtain good strength properties as well as the good watermark which is for practical purposes an essential for high security documents especially banknotes. The polyvinyl alcohol fibres having the described core may be produced by a co-extrusion process or a 0.5 to 0.8 denier fibre tow of the core material may be passed through a bath of polyvinyl alcohol having a molecular weight of 50,000 to 150,000 wherein a coating of polyvinyl alcohol is applied to the fibre. The fibre is then wired and subsequently heat treated in order to increase the solubility of the polyvinyl alcohol to a value within the 95° to 100° C. range, e.g. 99° C. The resulting tow fibre is then cut to produce a staple fibre length of say 5 mm. Fibres produced in this way provide enhanced strength properties and improved bonding characteristics and also have a greatly reduced impact on the normal deterioration of watermark quality in comparison to their uncoated fibres.

It is an essential part of the present invention that high quality watermarks are achieved. As is well known, if the mobility of the papermaking fibres is insufficient, the watermark becomes poor or virtually indiscernible. This is because, either the hydrodynamic forces are insufficient to move the fibres or alternatively because the fibre mobility is hampered by their length. Such immobility prevents fibres from accumulating in the troughs of the watermark embossing and from migrating away from the peaks of such embossings during the forming process and results in a poor quality watermark. It is known that the usual papermaking cotton fibres for security papers are in the region of 1 mm long whilst synthetic fibres are generally used in the region of 3–5 mm long. It is well known that the greater length of the synthetic fibres generally causes them to produce a markedly inferior watermark by virtue of their inherent lesser mobility.

It is a marked feature of the present invention that the polyvinyl alcohol fibres which are soluble in water at a temperature from 95° C. to 100° C., because of their inherent lubricity, exhibit greatly improved mobility during the paper forming stage which in turn results in a markedly improved watermark quality when compared to paper containing insoluble polyvinyl alcohol fibres such as disclosed in Dutch patent publication number 9 301 835. A superior performance of the polyvinyl alcohol fibres required for the present process is clear from both the definition and contrast of watermarks made using these fibres.

When the papermaking fibres are in suspension prior to the paper-forming process, the fibre concentration is typically 0.2%, as is well known in the art. At this concentration, there is a natural tendency for the fibres to interact. For long fibres, such interaction results in the fibres clumping together. This clumping together may lead to flocculation and we have found that the tendency to clump or to flocculate is markedly less in dispersion of fibres as a result of the presence in the suspension of the polyvinyl alcohol fibres which are soluble in water at temperatures from 95° to 100° C. in comparison to the insoluble fibres described in Dutch patent publication number 9 301 835.

The use of polyvinyl alcohol fibres which are soluble in water at temperatures of from 95° to 100° C. can provide the benefit of both good strength properties in paper and superior watermark properties. This is a truly surprising combination of valuable properties and is not found when use is made of other water soluble polyvinyl alcohol fibres or insoluble (reinforcing) polyvinyl alcohol fibres.

The preferred polyvinyl alcohol fibres for use in this invention are those produced by the process of wet spinning.

The invention will now be described by way of example.

EXAMPLE 1

A furnish was produced, containing 5% by weight on total dry fibre of 5 mm, VPB102 PVOH fibres (soluble at 99° C., 5 mm long) and 95% by weight cotton fibres prepared in the usual way. This was applied to an embossed mould on a paper machine for paper in the manner commonly used for banknote paper. The wet paper was then processed in the usual way through the following sequential processes: pressing, drying, polyvinyl alcohol impregnation, further drying, calendering and finally reeling.

The paper thus produced was tested for doublefold and tear strength. The watermark was visually assessed according to the subjective criteria previously described. Paper made in exactly the same way but from a furnish comprising 100% by weight cotton fibre was also tested by way of comparison.

The following results were obtained:

| Furnish composition | Grammage | Doublefold MD | Doublefold CD | Tear MD | Tear CD |
|---|---|---|---|---|---|
| 95% cotton, 5% VPB102 × 5 mm | 83 | 5200 | 3000 | 1040 | 1200 |
| 100% cotton | 83 | 3400 | 2160 | 800 | 960 |

MD=machine direction
CD=cross section
Conditions—50% RH

| Furnish composition | Watermark Contrast | Watermark Definition | Watermark Background |
|---|---|---|---|
| 95% cotton, 5% VPB102 × 5 mm | good | good | good |
| 100% cotton | good | good | good |

EXAMPLE 2

One of the surprising aspects of the present invention is the distinct improvement in watermark quality achieved by fibres whose solubility is around 99° C. compared to those that are in soluble such as the VPB103 fibres described in the above-mentioned Dutch patent application. This is illustrated by results from tests carried out on such fibres.

In a direct comparison of two fibre types, VPB103 (insoluble, 3 mm long) described in the previously mentioned Dutch application and VPB102 (soluble at 99° C., 3 mm long) being one of the preferred fibres for this application, the following results were obtained. The assessment was divided into three categories, good, fair, poor as judged by one skilled in the art. The paper was produced on British Standard hand sheet machine and contained 5% by weight of PVOH fibres.

| Fibre Types | Watermark Contrast | Watermark Definition | Watermark Background |
|---|---|---|---|
| VPB 102 | Good | Good | Good |
| VPB 103 | Fair | Fair | Fair |

Further tests revealed the following empirical data relating to the watermark contrast. This showed the percent additional fibre thickness over the dark areas of the watermark compared to the non-watermarked area was far greater for the VPB102 fibres than for the VPB103 fibres.

| Fibre Types | Watermark Contrast % thickness increase relative to non-watermarked area: Portrait watermark | Bar watermark |
|---|---|---|
| VPB 102 | 14% | 8% |
| VPB 103 | 10% | 4% |

The contrast achieved by the VPB102 relative to the VPB103 was 40% better for the portrait watermark and 100% better for the bar watermark. This is a truly remarkable and surprising difference in performance and illustrates clearly the benefit represented by the fibre selection identified in this patent application.

What is claimed is:

1. A method for the manufacture of security paper, such as banknote paper, which method comprises forming a papermaking suspension comprising cellulosic fibres and polyvinyl alcohol fibres wherein the cellulosic fibres are present in an amount of at least 80% by weight of the total weight of the fibres in the suspension, characterised in that the polyvinyl alcohol fibres are soluble in water at temperatures of from 95° to 100° C., are 3 to 5 mm in length, and are present in an amount of from 2 to 10% by weight based on the weight of the fibres, wherein the papermaking suspension comprising cellulosic fibres and the polyvinyl alcohol fibres is dewatered through an embossed wire mesh, wherein the embossing creates a profile of peaks and troughs corresponding to the light and dark areas of the watermark, and the thus formed paper with the watermark feature after dewatering is thereafter dried to provide the resulting security paper.

2. A method as claimed in claim 1, wherein said cellulosic fibers consist of cotton fibers.

3. A method as claimed in claim 1, wherein said security paper is banknote paper.

4. A method as claimed in claim 1, wherein the cellulosic fibres are present in an amount of at least at least 90% by weight of the total weight of the fibres in the suspension.

5. A method as claimed in claim 1, wherein said polyvinyl alcohol fibres are present in an amount of from 4 to 8% by weight based on the weight of the fibres.

6. A method as claimed in claim 1, wherein the polyvinyl alcohol fibres are 0.3 to 2 denier.

7. A method as claimed in claim 6, wherein the polyvinyl alcohol fibres are 1 denier.

8. A method as claimed in claim 1, wherein the polyvinyl alcohol fibres have a core formed from some different polymeric fibre forming material.

9. A method as claimed in claim 8, wherein the core is formed from a polyester, a polyamide or viscose.

* * * * *